US006176189B1

(12) United States Patent
Tomita

(10) Patent No.: US 6,176,189 B1
(45) Date of Patent: Jan. 23, 2001

(54) SEWING MACHINE HAVING A NON-VOLATILE MEMORY

(75) Inventor: Shintaro Tomita, Nagoya (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/605,540

(22) Filed: Jun. 29, 2000

(30) Foreign Application Priority Data

Jul. 5, 1999 (JP) ..... 11-190153

(51) Int. Cl.[7] ..... D05B 19/08; D05C 5/04

(52) U.S. Cl. ..... 112/102.5; 112/470.04; 112/475.19; 700/138

(58) Field of Search ..... 112/470.04, 470.06, 112/475.19, 102.5, 445, 454, 457, 456, 458, 453; 700/138

(56) References Cited

U.S. PATENT DOCUMENTS 5,389,868 * 2/1995 Mikami et al. ..... 112/454 X
5,911,181 * 6/1999 Muto ..... 112/102.5
5,924,372 * 7/1999 Okuda et al. ..... 112/102.5

FOREIGN PATENT DOCUMENTS 5-228275 9/1993 (JP) .

* cited by examiner

*Primary Examiner*—Peter Nerbun
(74) *Attorney, Agent, or Firm*—Oliff & Berridge, PLC

(57) ABSTRACT

A sewing machine that can set the sewing conditions for each stitch pattern and can store the set sewing conditions in a non-volatile memory in correspondence with each stitch pattern. The sewing conditions previously set for a certain stitch pattern can be used when the same stitch pattern is selected later.

22 Claims, 13 Drawing Sheets

SEWING MACHINE HAVING A NON-VOLATILE MEMORY

BACKGROUND OF THE INVENTION

1. Field of Invention

The invention relates to a sewing machine. Particularly, to a sewing machine that sets the sewing conditions, such as the stitch width, stitch length, and thread tension, for each stitch pattern and rewritably stores the set sewing conditions in a non-volatile memory in correspondence with each stitch pattern.

2. Description of Related Art

A conventional sewing machine with a display commonly displays various types of sewable stitch patterns to allow an operator to select a desired stitch pattern therefrom, as a stitch pattern to be sewn, and also displays at least part of the selected stitch pattern or the name of the selected stitch pattern to notify the operator of the selected stitch pattern.

An electronically controlled sewing machine of this kind is widely available and is designed to display, on a display, the sewing conditions (stitch width, stitch length, thread tension, and the like) for a selected stitch pattern if it is a utility stitch pattern, such as a straight stitch pattern or a zigzag stitch pattern, in order to allow an operator to set the sewing conditions using sewing condition setting keys.

As shown in FIG. 13, a sewing machine the applicants have put to practical use has a display 100 and a plurality of touch keys provided on the surface of the display 100. The functions of the touch keys are displayed on the display 100. For example, when a zigzag pattern key 102 is pressed on a utility stitch pattern selection screen 101, a zigzag stitch pattern is selected as the stitch pattern to be sewn.

Then, at the top of the display 100, a horizontal zigzag stitch pattern and the stitch pattern name "Zigzag (C)" are displayed. Also, below a plurality of stitch patterns, as displayed on the display 100, the stitch width "7.0 mm", the stitch length "2.5 mm", and the thread tension "5" are displayed as the sewing conditions of the selected zigzag stitch pattern. The thread tension "5" represents the fifth level from the weakest level on a 1-to-9 scale, and is indicated by an illuminating indicator lamp that is the fifth from one end of a row of nine indicator lamps.

Default values for the sewing conditions for various types of stitch patterns are prestored in a ROM of a control unit. Assuming that FIG. 13 shows a screen displayed immediately after a zigzag stitch pattern has been selected, the stitch width "7.0 mm", the stitch length "2.5 mm", and the thread tension "5" are displayed as the sewing condition default values for the zigzag stitch pattern.

On the utility stitch pattern selection screen 101, a plurality of touch sewing condition setting keys 103*a*, 103*b*, 104*a* 104*b*, 105*a*–105*c* are provided to allow an operator to change the sewing condition default values to desired values.

As described above, in the conventional electronically controlled sewing machine, the sewing condition default values are read from the ROM each time a stitch pattern is selected, and an operator uses the sewing condition setting keys to change the sewing condition default values to desired values. As desired sewing conditions are hard to set only by judging from the displayed sewing conditions, the sewing conditions are set, in many cases, and a trial sewing is then performed.

In the conventional electrically controlled sewing machine, the sewing condition default values stored in the ROM are set as the sewing conditions, each time a stitch pattern is selected. Thus, even when the sewing condition for a certain stitch pattern has been set as desired, the set sewing conditions cannot be used when the same stitch pattern is selected later.

The sewing conditions previously set for a certain stitch pattern are often desired to be used again when the same stitch pattern is selected. In such a case, however, the desired sewing conditions must be set again, using the sewing condition setting keys to change the sewing condition default values. Trial sewing must then be again performed if needed to verify the stitch is as desired. This procedure is very tedious.

On the other hand, because the sewing condition default values for a stitch pattern are normally set to be optimal values so as to provide preferable conditions for sewing the stitch pattern, there is a case where the sewing conditions changed for a certain stitch pattern are desired to be reset to the default values when the same stitch pattern is selected later.

Japanese Laid-open Patent Publication No. 5-228275 discloses an embroidery machine in which its operating environment is set and registered in an EEPROM for each operator or for each machine part condition, and the operating environment is suitably set by selecting the operator or the machine part condition to be used. In this embroidery machine, however, the sewing conditions cannot be set for each stitch pattern.

SUMMARY OF THE INVENTION

The invention provides a sewing machine that can set the sewing conditions for each stitch pattern, and store the set sewing conditions in a non-volatile memory in correspondence with each stitch pattern to allow the set sewing conditions to be used later, and also easily reset changed sewing conditions to the default values.

In this regard, a sewing machine of the embodiment of the invention may include a stitch formation mechanism capable of forming plural kinds of stitch patterns on a work cloth, a sewing condition setting device that sets a sewing condition for each stitch pattern, the sewing condition being used for forming the stitch pattern by the stitch formation mechanism, a nonvolatile memory that rewritably stores the sewing condition, and a writing device that writes the sewing condition into the non-volatile memory in correspondence with each stitch pattern set by the sewing condition setting device.

According to the sewing machine structured as described above, a sewing condition setting device sets a sewing condition for each stitch pattern, the writing device writes the sewing condition into the non-volatile memory in correspondence with each stitch pattern set by the sewing condition setting device and then the stitch formation mechanism forms the stitch pattern on a work cloth using the sewing condition for the stitch pattern. Therefore, as the non-volatile memory stores the sewing condition for each stitch pattern, when the previously set sewing conditions are desired to be used for a certain stitch pattern, the sewing condition stored in the non-volatile memory can be used. Accordingly, as there is no need to set the sewing conditions for the previously used certain stitch pattern again, sewing condition setting will be greatly facilitated and sewing operability will be greatly improved.

In a preferred aspect of the invention, the sewing machine may include a reset device that allows the stitch formation mechanism to form the stitch pattern according to a sewing condition default value. Further, the reset device may include a sewing condition default value storage device that stores the sewing condition default value. According to the sewing machine structured as described above, even after changing the sewing condition using the sewing condition setting device, it is possible to quickly reset the sewing condition using the sewing condition default value.

In a preferred aspect of the invention, the sewing machine may include a display including a touch key panel thereon, the sewing condition setting device includes a setting key for setting the sewing condition on the touch key panel, the writing device includes a writing key, on the touch key panel, for instructing writing the stitch condition into the non-volatile memory. Further the writing key may be disposed near the setting key on the touch key panel. According to the sewing machine structured as described above, as setting the sewing condition and instructing writing the stitch condition into the nonvolatile memory can be performed using the touch key panel, the operability of the sewing machine can be greatly improved. In addition, in case where the writing key is disposed near the setting key, over all operability of the two keys can be greatly improved.

In a preferred aspect of the invention, the reset device may include a reset key on the touch key panel, and the reset key is disposed near the setting key. According to the sewing machine structured as described above, because resetting the sewing condition can be performed using the touch key panel, the operability of the saving machine can be greatly improved and over all operability of three types of keys including the setting key, the writing key and the reset key can be greatly improved.

In a preferred aspect of the invention, the non-volatile memory preliminarily may store the sewing condition default value for a plurality of types of stitch patterns in an initial state. According to the sewing machine structured as described above, the sewing machine can perform sewing using the sewing condition default value for the plurality of types of stitch patterns without the trouble of setting the sewing conditions.

In a preferred aspect of the invention, the sewing conditions may include at least one of stitch width, stitch length, thread tension, thread density, presser foot type or presser foot pressure. According to the sewing machine structured as described above, the sewing condition setting device can set at least one of stitch width, stitch length, thread tension, thread density, presser foot type or presser foot pressure and the writing device can write it into the non-volatile memory in correspondence with each stitch pattern set by the sewing condition setting device.

BRIEF DESCRIPTION OF THE DRAWINGS

A preferred embodiment of the invention will be described in detail with reference to the following figures wherein.

DETAILED DESCRIPTION OF PREFERRED EMBODIMENTS

A preferred embodiment according to the invention as applied to an electronically controlled sewing machine will now be described with reference to the accompanying drawings. The electronically controlled sewing machine has a removable embroidery unit, and can sew embroideries when the embroidery unit is mounted and sew normal stitches (utility stitches, such as straight stitches and zigzag stitches) when the embroidery unit is removed.

Figure 1:
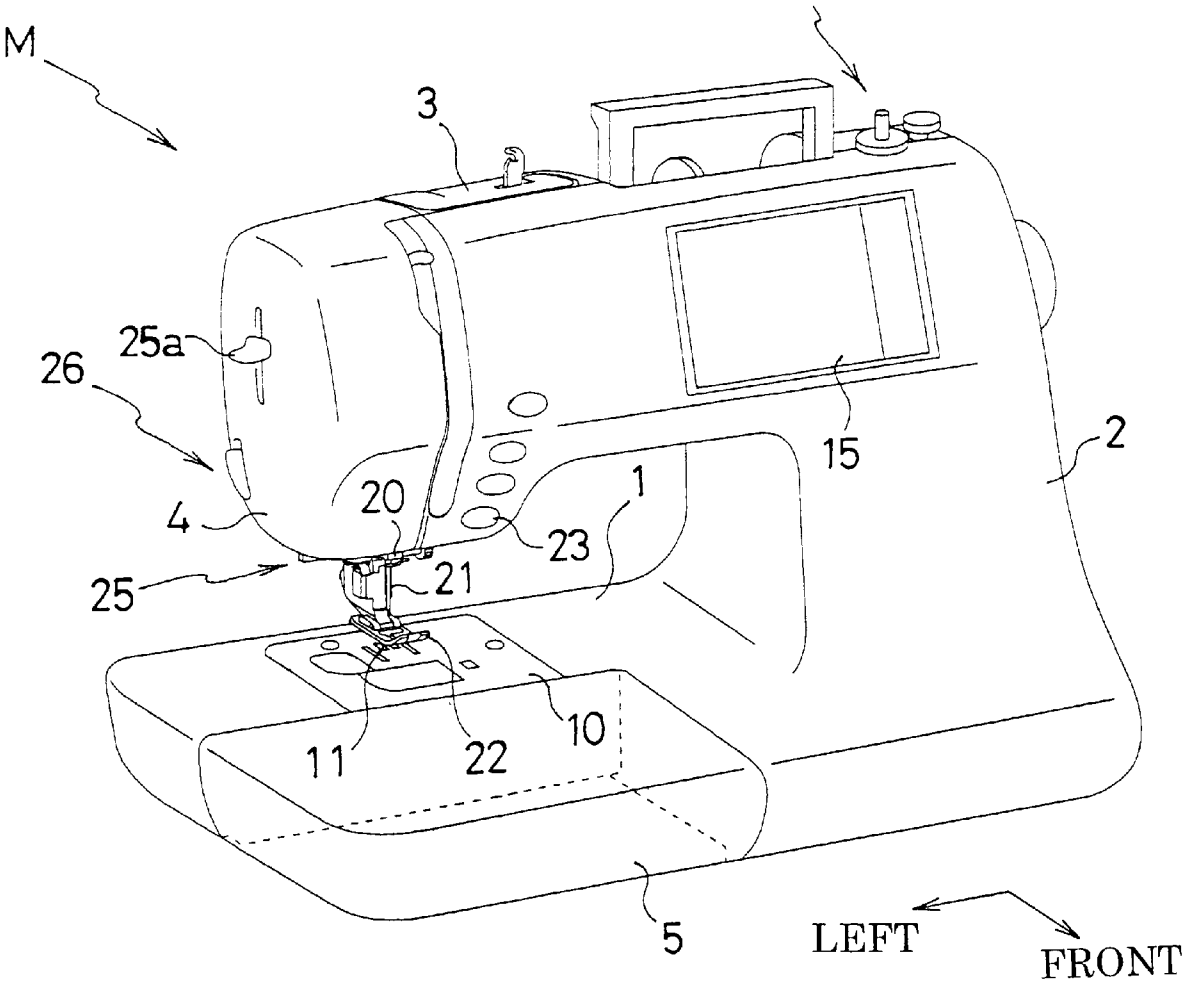
FIG. 1 is a perspective view of an electronically controlled sewing machine M according to a preferred embodiment of the invention.

As shown in FIG. 1, an electronically controlled sewing machine M has a bed 1, a standard portion 2 extending upwardly from the right end portion of the bed 1. An arm 3 extending leftwardly from the top of the standard portion 2 so as to face and be parallel to the bed 1, and a head 4 located at the left end of the arm 3.

The bed 1 is provided with a throat plate 10, a feed dog 11, a feed dog up/down moving mechanism (not shown) that moves a feed dog 11 up and down, a feed dog back/forth moving mechanism (not shown) that moves the feed dog 11 back and forth, and a loop taker mechanism (not shown) having a rotary hook that engages an upper thread and a bobbin thread to form stitches in cooperation with a vertically moving needle 21. When normal stitches are sewn, an auxiliary bed 5 in detachably attached to the bed 1. The embroidery unit 6 (FIG. 2) can be mounted/dismounted to/from the bed 1 when the auxiliary bed 5 is not attached to the bed 1.

A vertically elongated color liquid crystal display (LCD) 15 is attached to the front face of the arm 3. At the front face of the display 15, a plurality of touch keys 16 (FIG. 2) made of transparent electrodes are arranged in a matrix form. At the right top of the arm 3, a bobbin thread winding mechanism 17 is provided for winding a bobbin thread around a bobbin (not shown), which is to be accommodated in the rotary hook.

Figure 2:
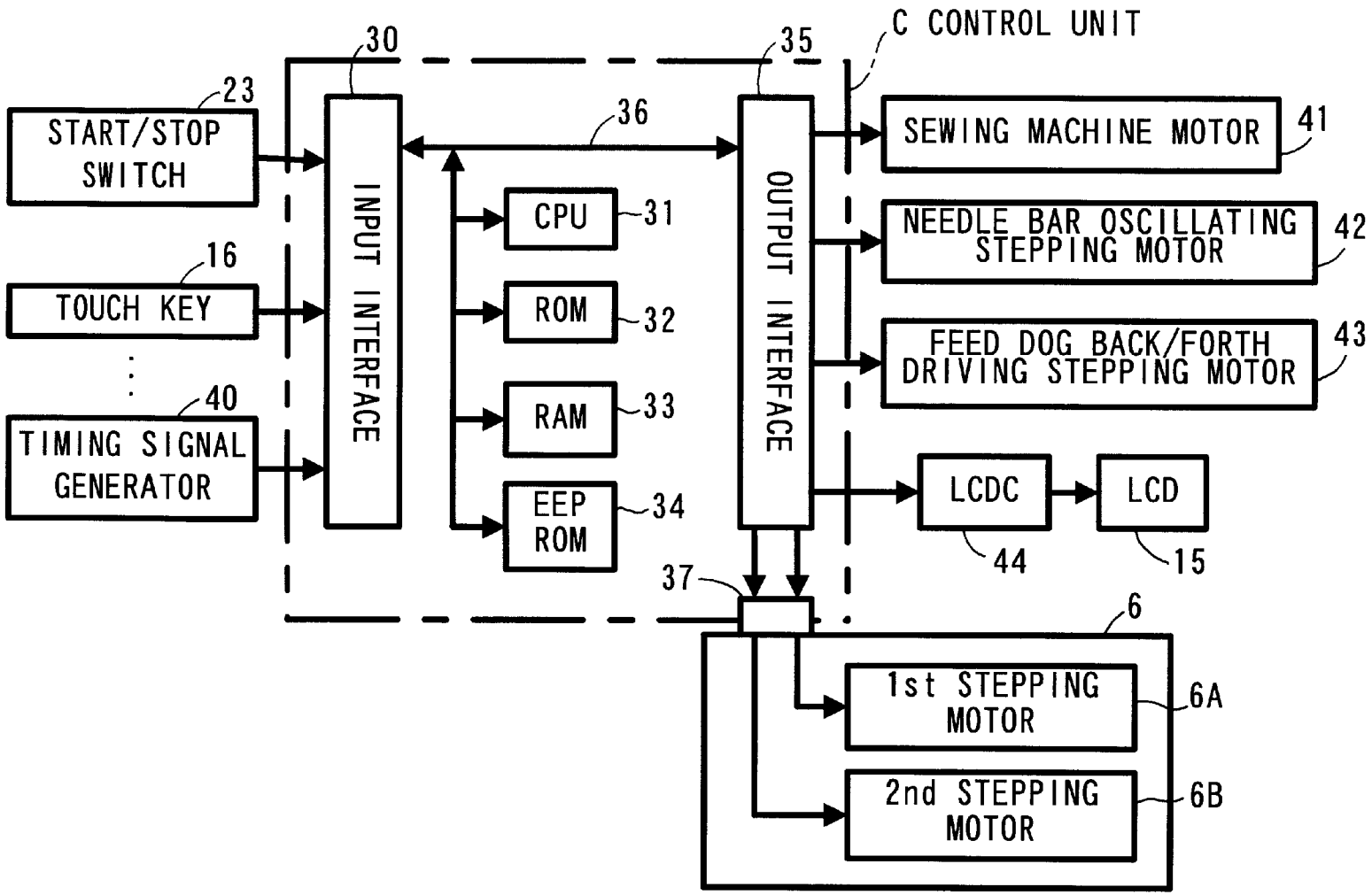
FIG. 2 is a block diagram showing the control system of the electronically controlled sewing machine M.

A needle bar 20 is supported on the head 4 so as to be vertically movable. The needle 21 is mounted at the lower end of the needle bar 20. Provided inside the head 4 and the arm 3 are a needle bar driving mechanism (not shown) that vertically moves the needle bar 20, a needle bar oscillating mechanism (not shown) that oscillates the needle bar 20 right and left, and a thread take-up lever driving mechanism (not shown) that vertically moves a thread take-up lever in a timed relationship with the vertical motion of the needle bar 20. The feed dog up/down moving mechanism, the needle bar driving mechanism, and the thread take-up lever driving mechanism are driven by a sewing machine motor 41, the needle bar oscillating mechanism is driven by a needle bar oscillating stepping motor 42, and the feed dog back/forth moving mechanism is driven by a food dog back/forth driving stepping motor 43 (FIG. 2).

A presser foot 22 is provided to the head 4 so as to press, in the vicinity of the needle 21, a work cloth against the upper surface of the bed 1. A start/stop switch 23 for commanding the sewing machine M to start and stop sewing is provided at the front face of the head 4. Further, a thread tension adjusting mechanism that can adjust the thread tension during sewing is provided. A needle threading mechanism 25 that threads a needle thread through an eye of the needle 21 when a needle threading lever 25*a* is operated, and a thread cutting mechanism 26 that cuts a thread when threads are changed are provided at the head 4.

The control system of the electronically controlled sewing machine M will now be described. As shown in FIG. 2, a control unit C has a computer including an input interface 30, a CPU 31, a ROM 32, a RAM 33, and an EEPROM 34, that is nonvolatile and electrically rewritable, and an output interface 35. These devices are connected using a bus 36, such as a data bus.

The start/stop switch 23, the touch keys 16, and a timing signal generator 40 that detects rotation phases of a main shaft of the sewing machine M are connected to the input interface 30. The motors 41–43 and a display controller (LCDC) 44 for the LCD 15 are connected to the output interface 35. The first and second stepping motors 6*a,* 6*b* that individually drive an embroidery frame of the embroidery unit 6 back and forth, and left and right, are connectable to the output interface through a connector 37.

Figure 3:
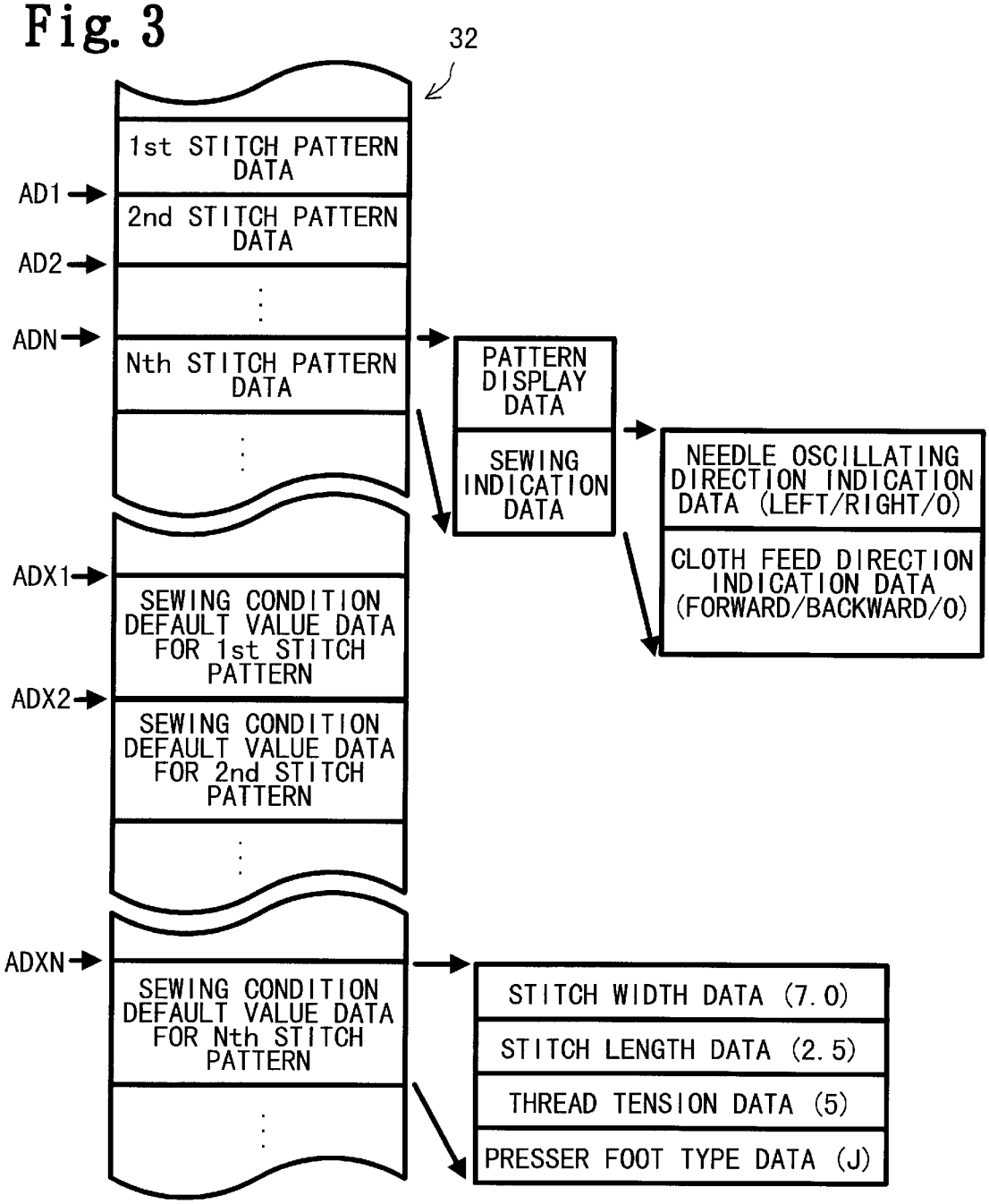
FIG. 3 is a diagram showing the structure of data contained in a ROM.

As shown in FIG. 3, the ROM 32 stores pattern data of a plurality of utility stitch patterns (first stitch pattern, second stitch pattern . . . Nth stitch pattern, . . . ), including straight stitches and zigzag stitches, at addresses (AD1, AD2 . . . ADN, . . . ) in correspondence with the pattern numbers (1, 2, . . . N, . . . ). Sewing condition default value data for the stitch patterns are stored at addresses (ADX1, ADX2 . . . ADN, in correspondence with the pattern numbers. The ROM 32 that stores the sewing condition default value data corresponds to a sewing condition default value storage device.

The pattern data of each stitch pattern includes pattern display data and sewing indication data. The sewing indication data includes needle oscillating direction indication data for indicating the needle oscillating direction (left, right, or zero) relative to each needle drop position, and feed direction indication data for indicating feed the work cloth feed direction (forward, backward, or zero) relative to each needle drop position.

The sewing condition default value data for each stitch pattern includes stitch width data, stitch length data, thread tension data, and presser foot type data. The stitch width data defines the width of a stitch formed when the needle 21 oscillates right or left, and the stitch length data defines the amount of work cloth fed by the feed dog 11 to form a stitch. The thread tension data defines the level of tension applied to a needle thread during stitch forming. For example, the thread tension "5" represents the fifth level from the weakest level on a 1-to-9 scale, and is indicated by an illuminating indicator lamp that is the fifth from one end of a row of nine indicator lamps.

Figure 4:
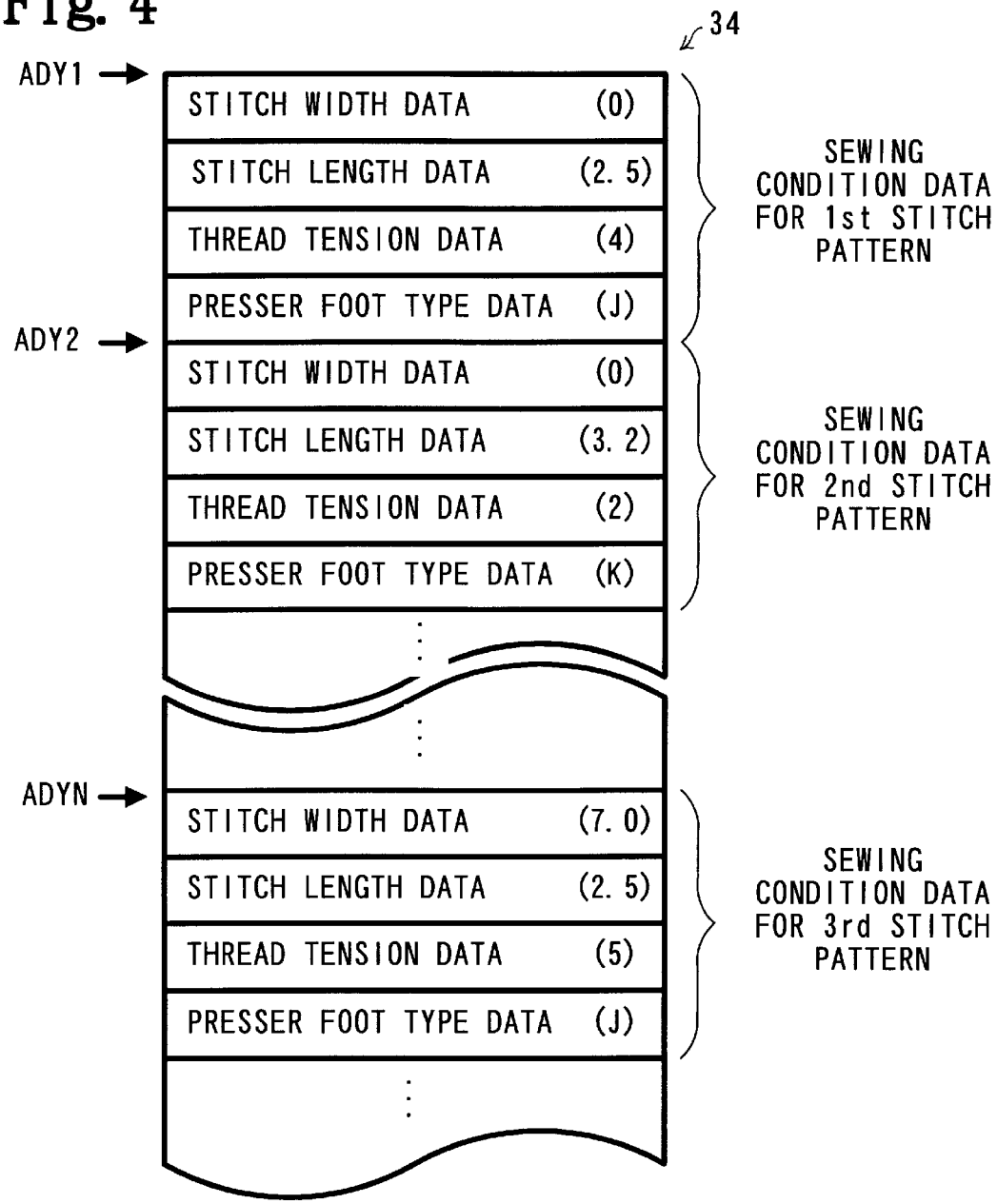
FIG. 4 is a diagram showing the structure of data contained in an EEPROM.

As shown in FIG. 4, the EEPROM 34 stores sewing condition data for various types of stitch patterns at addresses (ADY1, DY2, . . . ADYN . . . ) in correspondence with the stitch numbers. The sewing condition data for each stitch pattern includes stitch width data, stitch length data, thread tension data, and presser foot type data, just as the sewing condition default value data does.

Further, the ROM 32 stores a general control program for performing sewing control and display control, as well as a pattern selection control program for allowing selection of a desired stitch pattern from various types of stitch patterns. In addition, the ROM 32 stores programs unique to the invention, that is, a sewing condition setting control program for allowing setting of the sewing conditions for each stitch pattern, and a data storing control program for storing the sewing conditions set by the sewing condition setting control in the EEPROM 34 in correspondence with the associated stitch pattern (stitch number). Also, the ROM 32 stores pattern data of various types of embroidery patterns and a selection/sewing control program for the embroidery patterns.

A control sequence executed by the control unit C and including the above-described pattern selection control, sewing condition setting control, and data storing control will now be described based on flowcharts shown in FIGS. 5 and 6, and by reference to FIGS. 7–12. Si(i=1, 2, 3 . . . ) shown in the flowcharts represents each step.

In an initial state before the control sequence is started, the sewing condition default values for various types of stitch patterns are prestored in the ROM 32 and the EEPROM 34. The initial state is a state where the sewing machine M has not ever been used after its production and no sewing conditions for any of the stitch patterns have been set by an operator using the sewing condition setting control. The following description, however, is applicable in the initial state and all subsequent uses of the sewing machine M.

Figure 5:
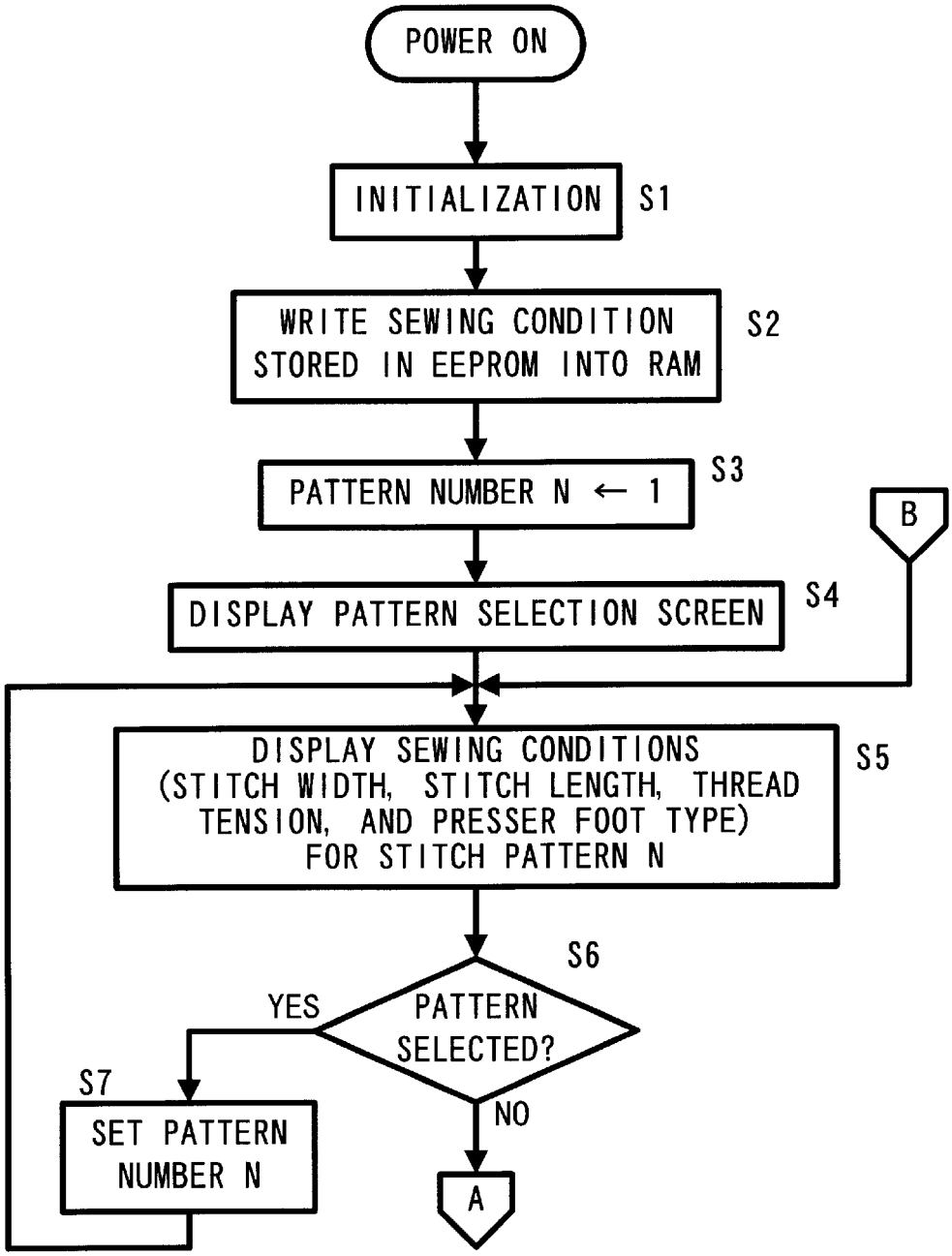
FIG. 5 is a flowchart (first half) of a control sequence executed by a control unit.

As shown in FIG. 5, when the power of the sewing machine M is turned on, initialization of the sewing machine M including clearing memories in the RAM 33 is executed (S1). Then, when the embroidery unit 6 is not mounted on the sewing machine M, the sewing condition data for various types of stitch patterns stored in the EEPROM 34 is written into the RAM 33 at addresses (ADZ1, ADZ2 . . . ADZN, . . . ) in correspondence with the pattern numbers (S2).

Figure 8:
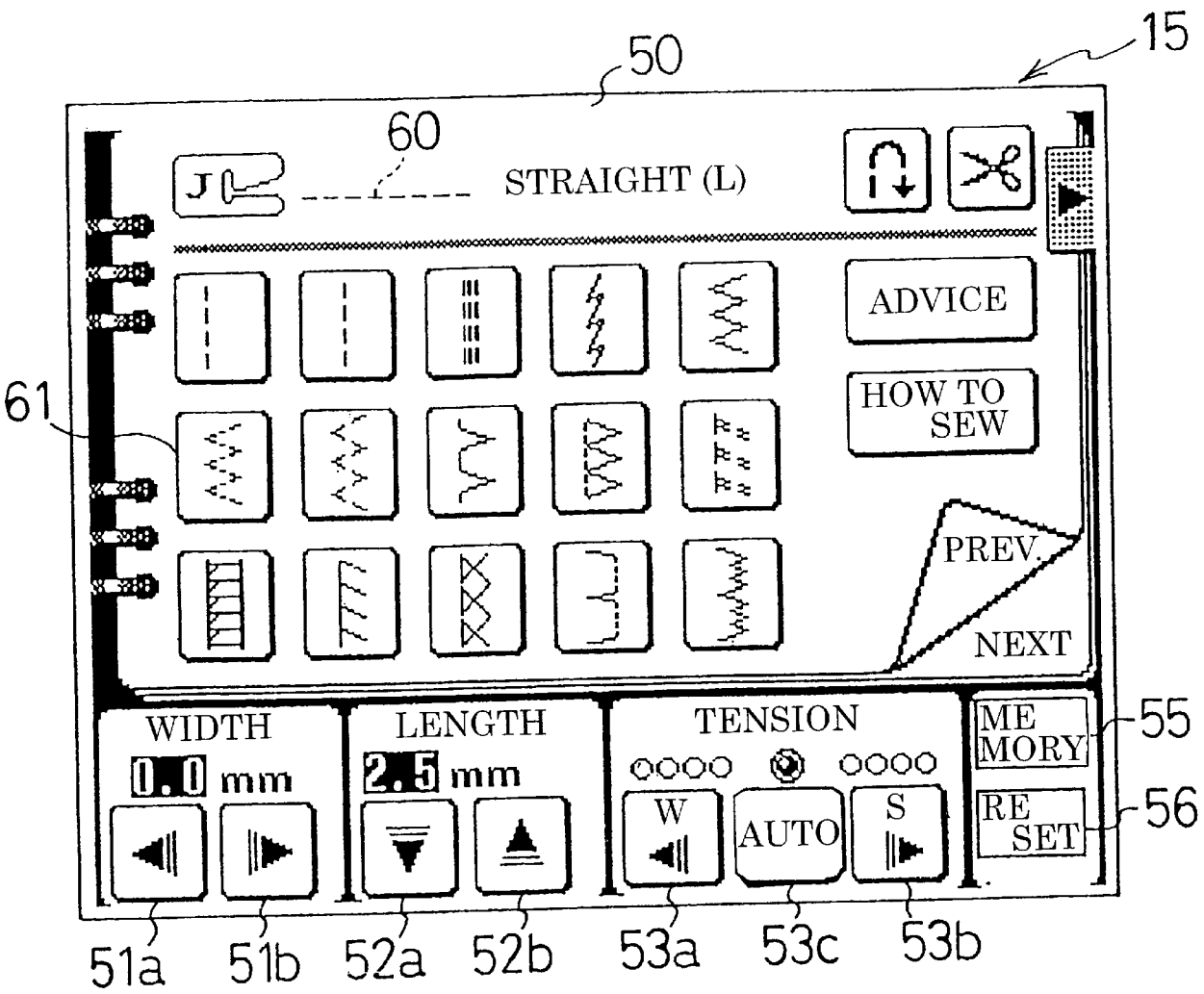
FIG. 8 shows a stitch pattern selection screen displayed on a display.

Then, the pattern number N is set equal to (S3), "1" and a pattern selection screen 50, shown in FIG. 8, appears on the display 15 (S4). On the pattern selection screen 50, the sewing conditions (stitch width, stitch length, thread tension, and presser foot type) for the stitch number N (1) are displayed based on the sewing condition data stored in the RAM 33 in correspondence with the pattern number N (S5).

Figure 9:
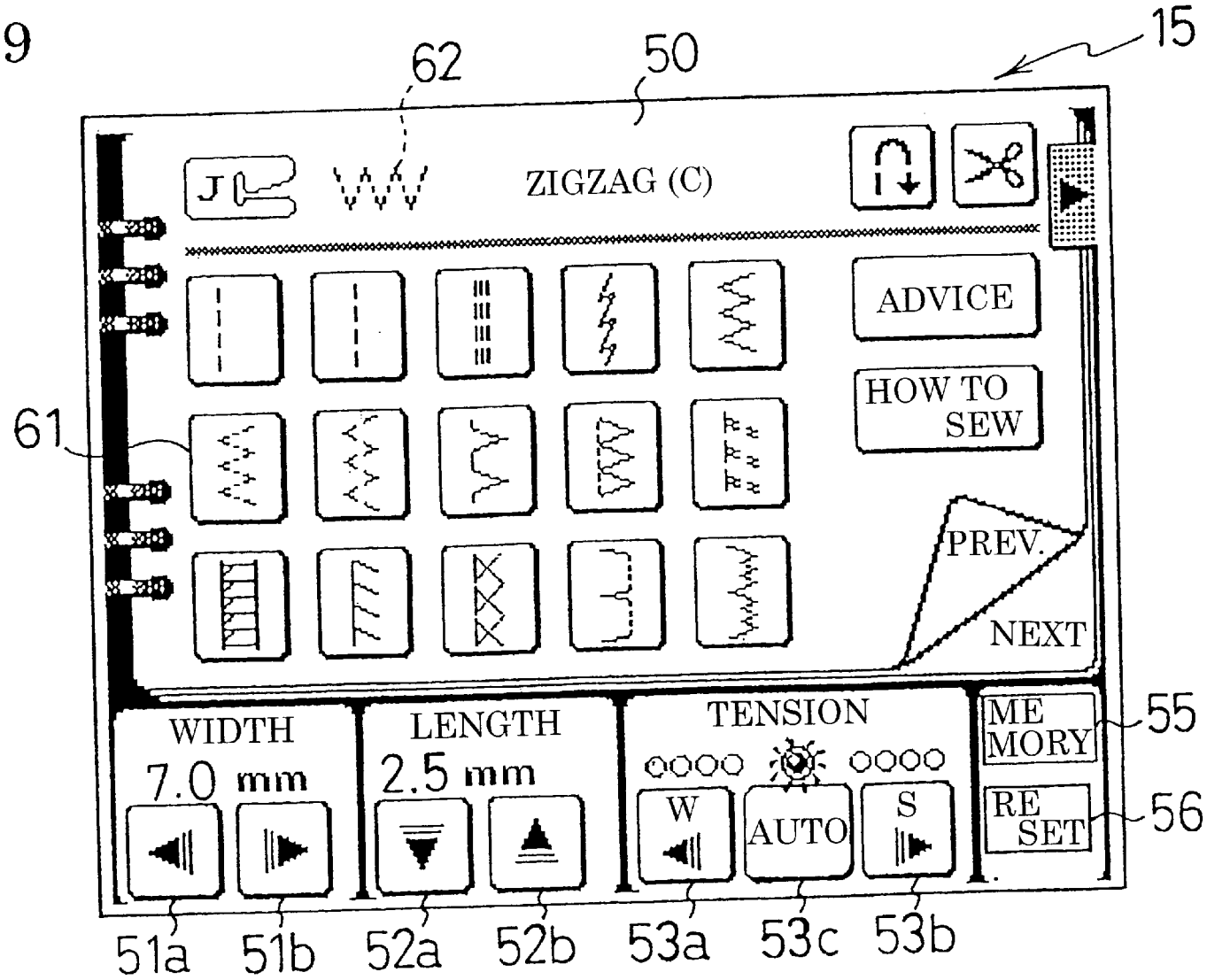
FIG. 9 shows the stitch pattern selection screen when a zigzag stitch pattern has been selected.
Figure 10:
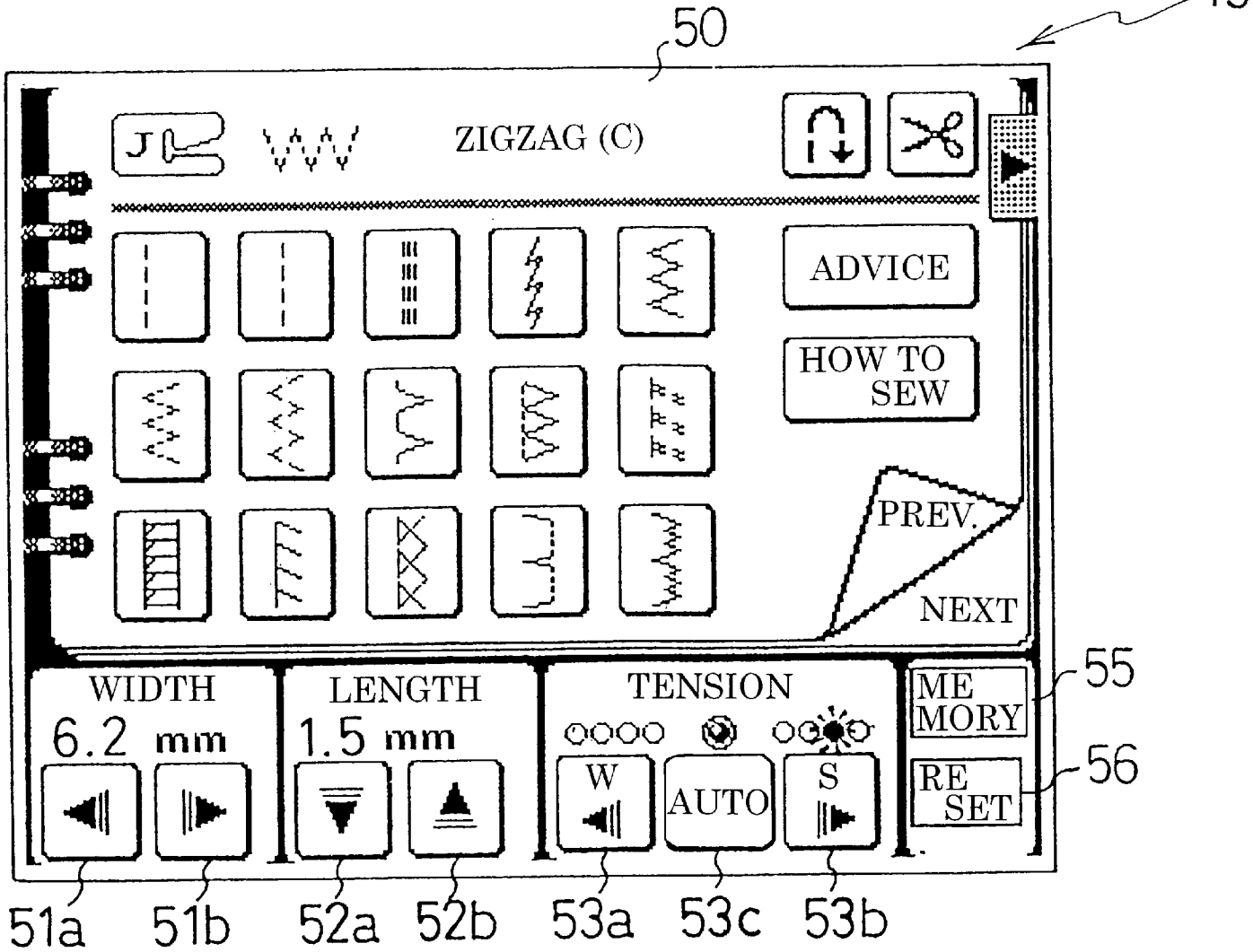
FIG. 10 shows the stitch pattern selection screen when the sewing conditions have been changed.

FIGS. 8–10 show the pattern selection screen 50 for the display 15. On the pattern selection screen 50, various types of sewable utility stitch patterns are displayed in the center of the screen 50 (for example, in the 3×5 matrix shown). Above the utility stitch patterns, the sewing condition (presser toot type) and the pattern name of a selected stitch pattern are displayed. Below the utility stitch patterns, the sewing conditions (stitch width, stitch length, and thread tension) are displayed.

Also, on the pattern selection screen 50, stitch width setting touch keys 51*a,* 5l*b,* are disposed near the stitch width indicating portion, feed amount setting touch keys 52*a,* 52*b* are disposed near the stitch length indicating portion, and thread tension setting touch keys 53*a*–53*c* are disposed near the thread tension indicating portion. Further, a "MEMORY" touch key 55, used to enter a command to store set data, and a "RESET" touch key, used to reset set data, are disposed just to the right of the tension indicating portion and the thread tension setting touch keys 53*a*–53*c*.

Right after the power of the sewing machine M is turned on, a straight stitch pattern assigned the stitch number 1 in automatically selected. As shown in FIG. 8, the sewing condition (presser foot type J), a horizontal straight stitch pattern 60, and the pattern name "Straight (L)" are displayed at the top of the pattern selection screen 50. In addition, the sewing conditions for the straight stitch pattern, that is, the stitch width "0.0", the stitch length "2.5", and the thread tension "5", are displayed at the bottom of the pattern selection screen 50.

Then, when a stitch pattern is selected by pressing a touch key 16 that corresponds to one of the stitch patterns (S6: Yes), the pattern number of the selected stitch pattern is set to the stitch number N (S7), and control returns to S5. Referring now to FIG. 9, an exemplary case where a zigzag stitch pattern is selected by pressing a zigzag pattern key 61 will now be described.

When a zigzag stitch pattern is selected, the sewing condition (presser foot type J) and a horizontal zigzag stitch pattern 62, and the pattern name "Zigzag (C)" are displayed at the top of the pattern selection screen 50, and the sewing conditions for the zigzag stitch pattern, for example, the stitch width "7.0", the stitch length "2.5", and the thread tension "5" are displayed at the bottom of the screen 50.

Figure 6:
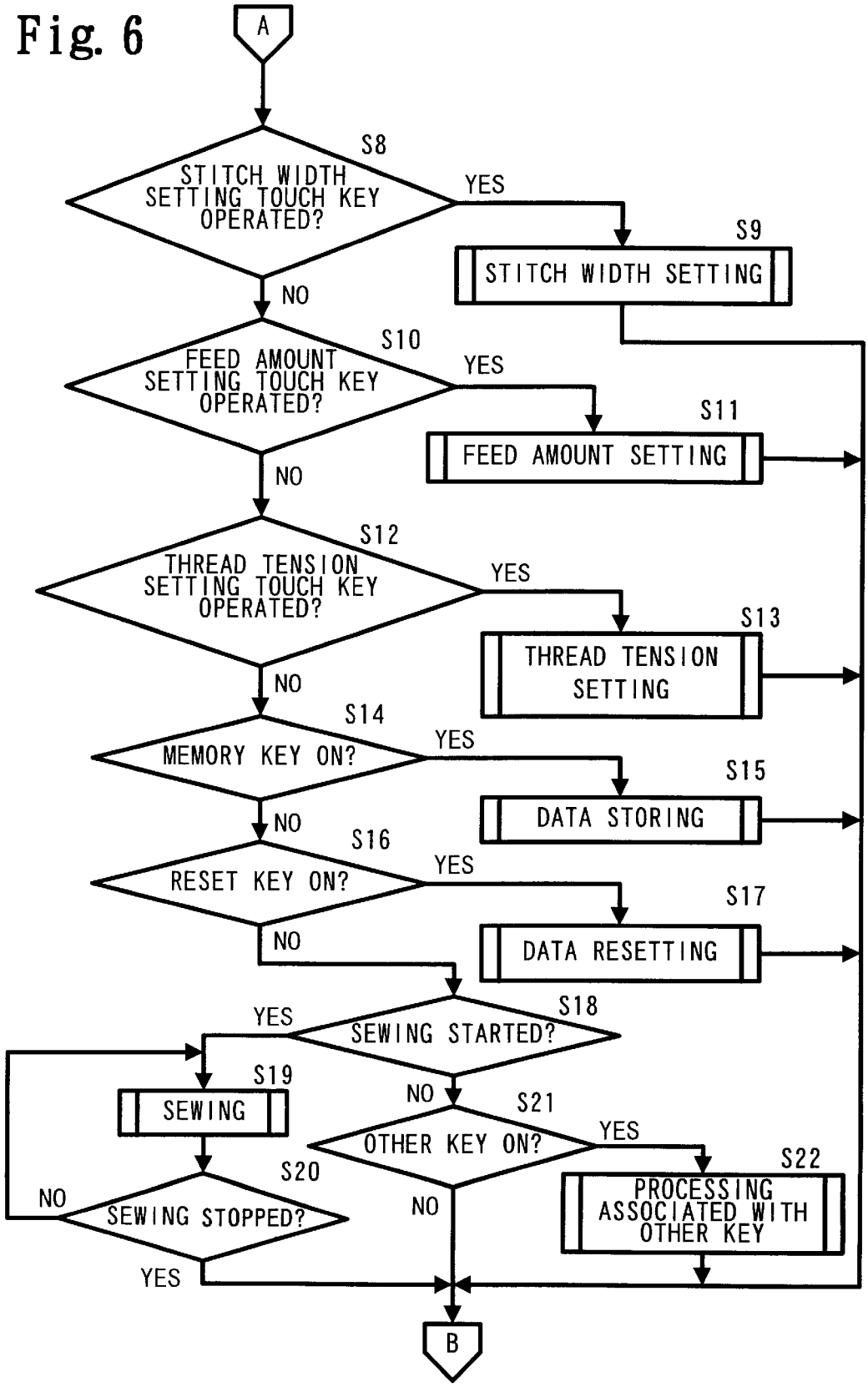
FIG. 6 is a flowchart (second half) of the control sequence executed by the control unit.
Figure 7:
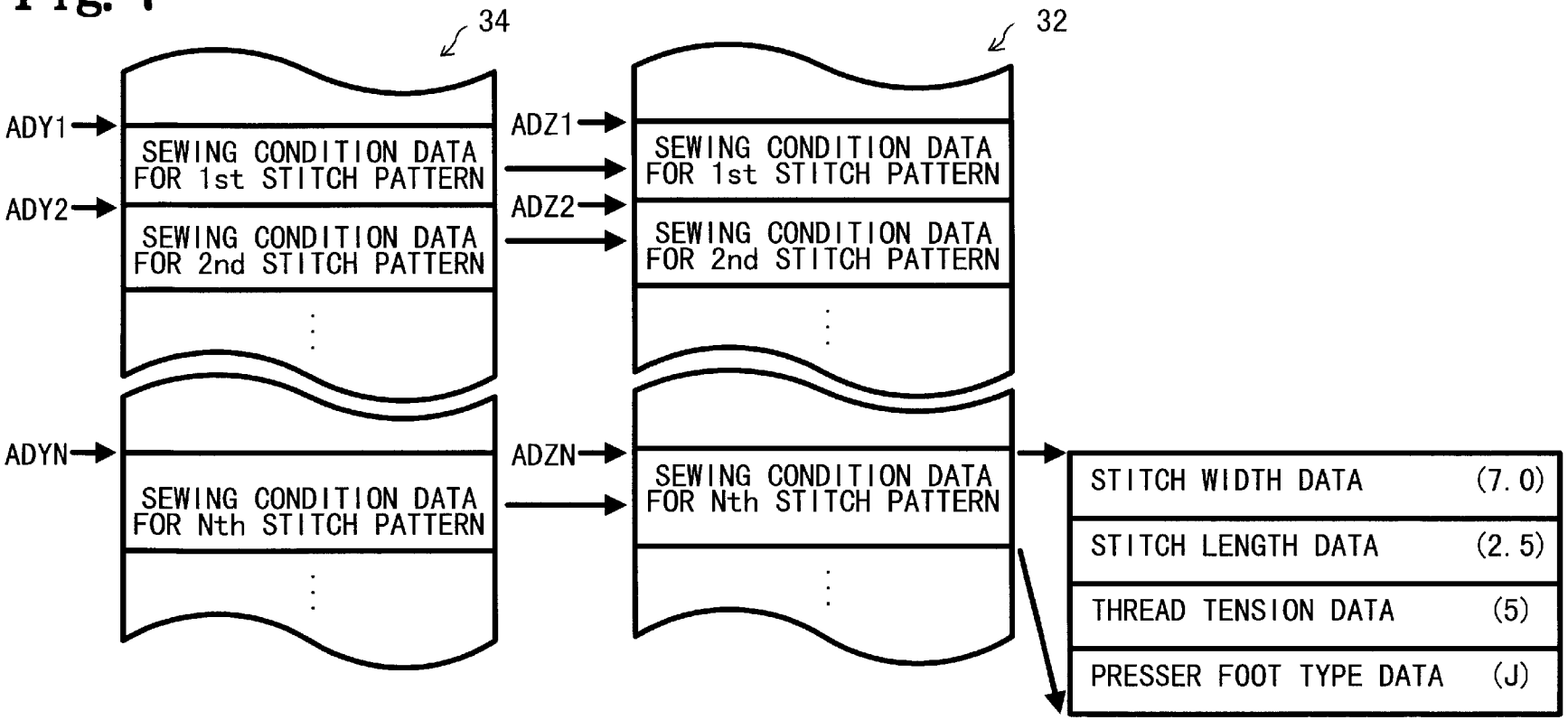
FIG. 7 is a diagram showing the structure of data contained in the EEPROM and a RAM (after a stitch pattern is selected)

After that, as shown in FIG. 6, when the stitch width setting touch keys 51*a,* 51*b* are operated (S8: Yes) to change the stitch width from "7.0 mm" to, for example, "6.2 mm" (in this case, the touch key 51*a* in operated to reduce the stitch width), stitch width setting is executed (S9). As a result, the stitch width data "7.0" storied in the RAM 33 is rewritten and set to "6.2". Then, control returns to S5. When the feed amount setting touch keys 52*a,* 53*b* are operated (S10: Yes) to change the feed amount from "2.5 mm" to, for example, "1.5 mm" (in this came, the touch key 52*a* is operated to reduce the feed amount in order to reduce the stitch length), feed amount setting is executed (S11). As a result, the feed amount data "2.5" stored in the RAM 33 in rewritten and set to "1.5". Then, control returns to S5.

When the thread tension setting touch keys 53*a,* 53*b* are operated (S12: Yes), to change the thread tension from "5" to, for example, "8" (in this case, the touch key 53*b* is operated to increase the thread tension), thread tension setting is executed (S13). As a result, the tread tension data "5" stored in the RAM 3 is rewritten and set to "8". Then, control returns to S5. When the thread tension setting touch key 53*c* is pressed, automatic thread tension adjusting control is performed by the control unit C.

In S5, the stitch width "6.2", the feed amount "1.5", and the thread tension "8" are displayed based on the stitch width data "6.2", the feed amount data "1.5", and the thread tension data "8" set in the RAM 33, respectively (FIG. 10).

Figure 11:
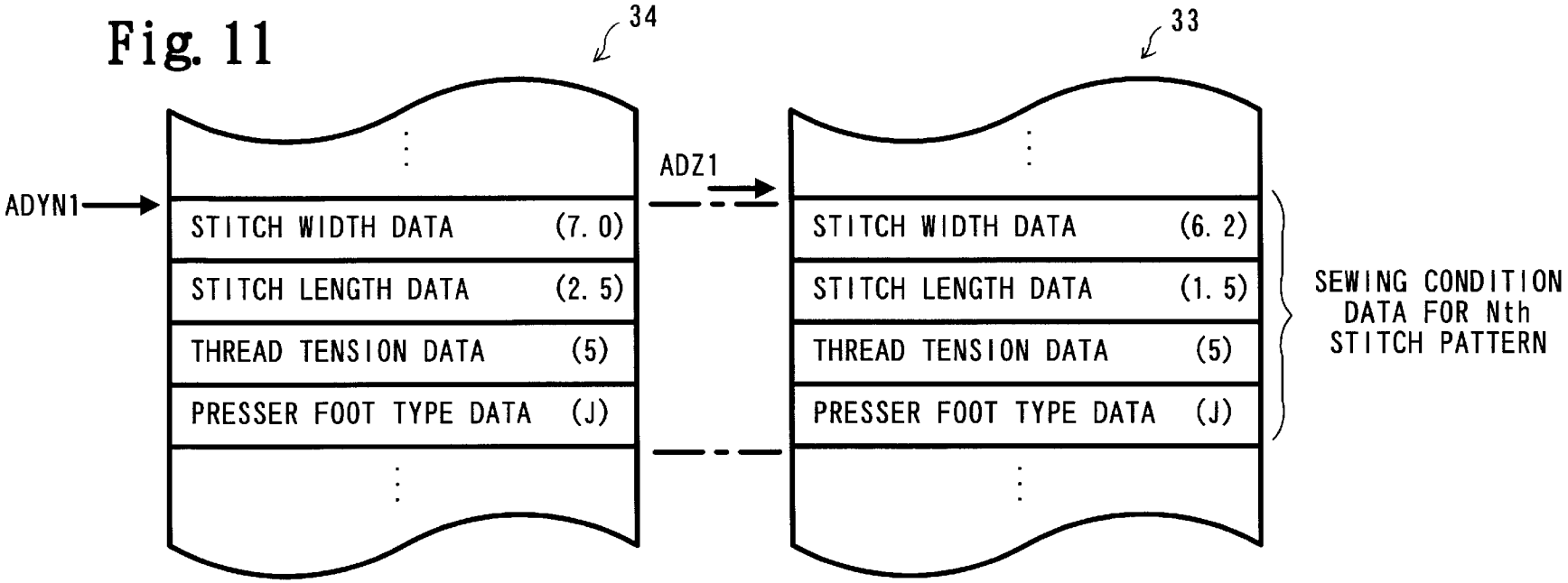
FIG. 11 in a diagram showing the structure of data contained in the EEPROM and the RAM before data is stored.
Figure 12:
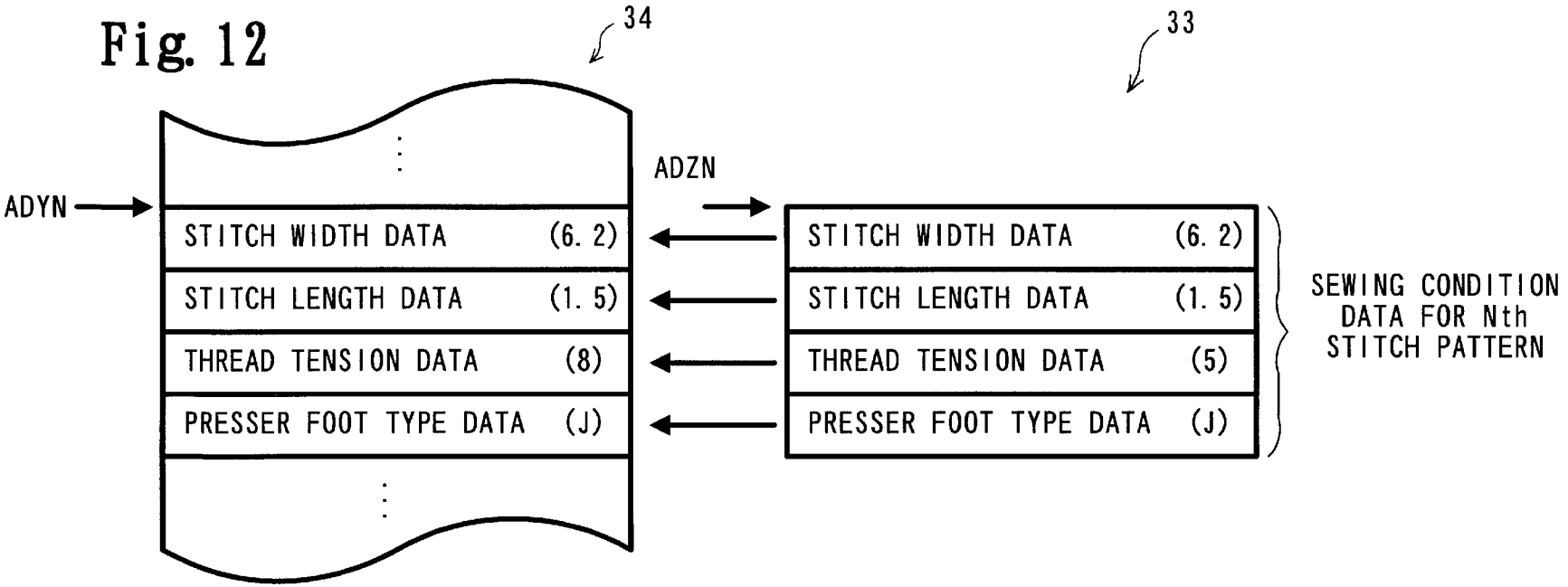
FIG. 12 is a diagram showing the structure of data contained in the EEPROM and the RAM after data has been stored.
Figure 13:
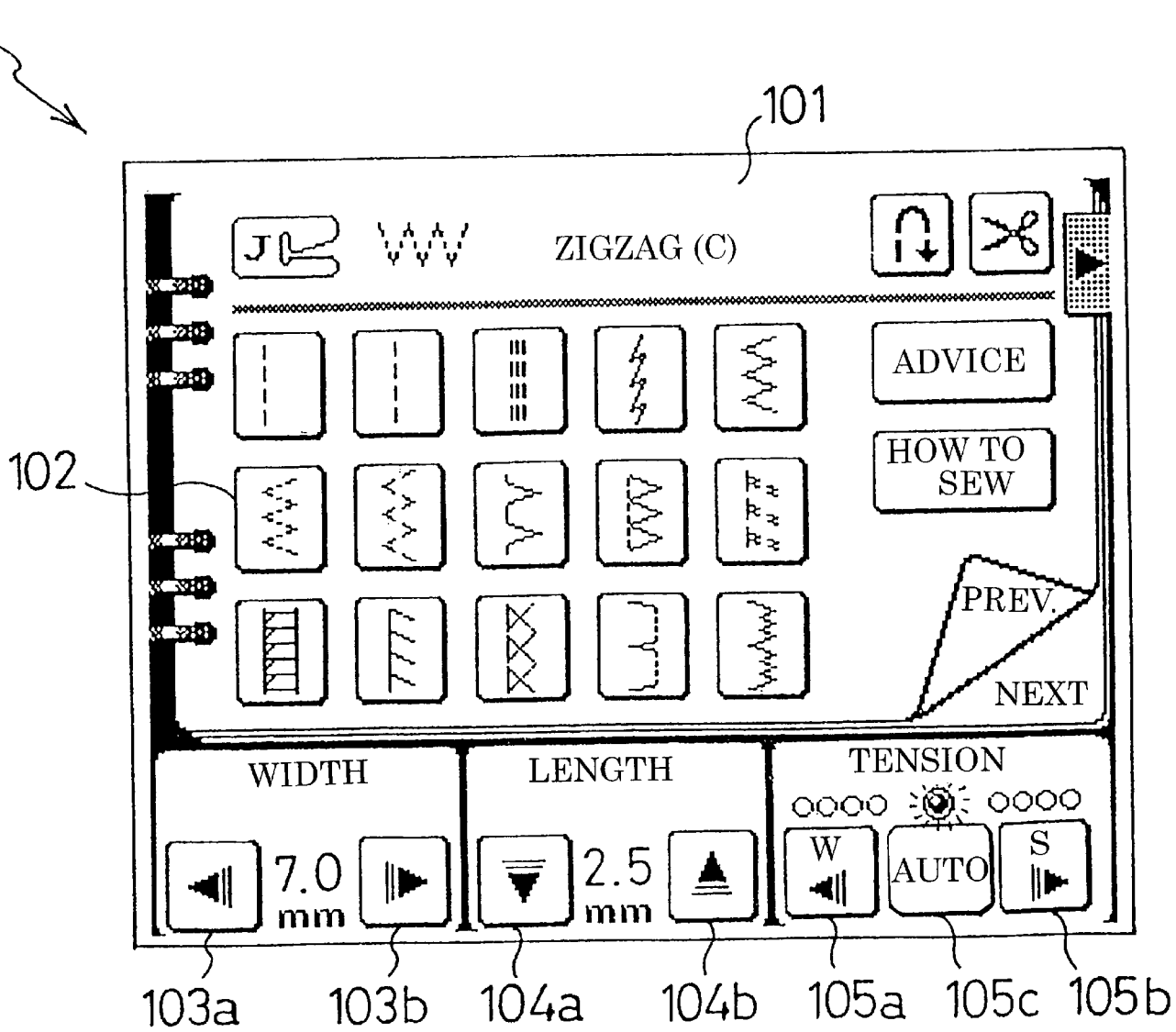
Fig.13 PRIOR ART
FIG. 13 shows a stitch pattern selection screen displayed on a related art display.

Then, when the "MEMORY" key is pressed (S14: Yes), data storing is executed (S15), and control returns to S5. When data storing has yet to be executed after sewing condition setting has been performed in S8, S9, and S1O, the sewing condition data before the setting is stored in the EEPROM 34, and the sewing condition data after the setting is stored in the RAM 33, as shown in FIG. 11. When data storing has been executed, the sewing condition data for the selected stitch pattern stored in the EEPROM 34 is overwritten with the corresponding sewing condition data stored in the RAM 33, as shown in FIG. 12.

When the "RESET" key 56 is pressed (S16: Yes), data resetting is executed (S17), and control returns to S5. When data resetting is executed, the sewing condition data stored in the EEPROM 34 and the RAM 33 are overwritten with the sewing condition default values, and the default values are used as the sewing condition data. Then, the sewing conditions are displayed based on the thus obtained sewing condition data in S5.

Then, when the start/stop switch 23 is turned on to start sewing (S18: Yes), sewing is executed (S19), and the motors 41–43 are driven to form the selected stitch pattern based on the sewing indication data stored in the ROM 32 and the sewing condition data stored in the RAM 33.

When sewing is NOT started by turning on the start/stop switch 23 (S18: No), and instead any key other than the switch 23 is pressed (S21: Yes), processing associated with the pressed key is executed (S22). Then, control returns to S5. When any other key is not pressed (S21: No), control also returns to S5.

Because the type of a presser foot used for sewing a stitch pattern rarely requires changing, a detailed description about how to set, store, and reset the presser foot type data is omitted here. The presser foot type can be set by pressing presser foot type setting touch keys displayed by predetermined key operation. Storing and resetting the presser foot type data can be accomplished in substantially the same manner as with the above-described sewing condition data. The operator mounts a presser foot by checking the displayed presser foot type.

As described above, in the electronically controlled sewing machine M according to the preferred embodiment, stitch width setting (S9), feed amount setting (S11), and thread tension setting (S13) are executed with the touch of the setting touch keys 51*a,* 51*b,* 52*a,* 52*b,* 53*a,* and 53*b,* and the sewing conditions (stitch width, feed amount (stitch length), thread tension) can be set for each stitch pattern. With the touch of the MEMORY key 55, data storing (S15) is executed and the sewing conditions set at the setting steps can be stored in the EEPROM 34 in correspondence with the associated stitch pattern.

Accordingly, the previously set sewing conditions for a certain stitch pattern can be used when the same stitch pattern is selected later. When the previously set sewing conditions are desired to be used, there is no need to set the sewing conditions again by touching the sewing condition setting keys 51*a,* 51*b,* 52*a,* 52*b,* 53*a,* and 53*b,* and by performing trial sewing if needed. Thus, sewing condition setting will be greatly facilitated and sewing operability will be greatly improved.

Further, by pressing the RESET key 56, data resetting (S17) is executed and the sewing condition default values stored in the ROM 32 can be used. Accordingly, the sewing conditions previously set for a certain pattern can be reset and, instead, the sewing condition default values can be used when the same stitch pattern is selected later.

The stitch width setting touch keys 51*a,* 51*b,* the feed amount setting touch keys 52*a,* 52*b,* and the thread tension setting touch keys 53*a*–53*c* are disposed horizontally and substantially in a line at the bottom of the display 15. In addition, the MEMORY key 55 and the RESET key 56 are disposed in the vicinity (just on the right) of the setting keys 51*a,* 51*b,* 52*a,* 52*b,* 53*a,* and 53*b.* Such a key disposition makes all the keys highly operable.

As described above, the sewing condition default values for various types of sewing patterns are prestored in the EEPROM 34 in the initial state. Accordingly, the default values can be used as the sewing conditions without the trouble of setting the sewing conditions by touching the setting keys 51*a,* 51*b,* 52*a,* 52*b,* 53*a,* and 53*b* to execute stitch width setting (S9), feed amount setting (S11) and thread tension setting (S13).

Other than the stitch width, feed amount, thread tension, and presser foot type, the thread density and the present foot pressure may be included as the sewing conditions. More specifically, the thread tension and the presser foot pressure may be displayed, and a thread density setting touch key and a presser foot pressure setting touch key may be provided to allow an operator to set them. In this case also, by pressing the MEMORY key 55, the set thread tension and the presser foot pressure can be stored in the EEPROM 34. Although, as a non-volatile memory, the EEPROM 34 is used in the above-described embodiment, a flash memory or the like may be used, instead.

While the invention has been described with reference to a specific embodiment, it is not restricted to the specific details set forth. Various modifications or changes maybe made by those skilled in the art without departing from the spirit and scope of the invention.

What is claimed is:

1. A sewing machine, comprising;

a stitch formation mechanism capable of forming a plurality of kinds of stitch patterns on a work cloth;

a sewing condition setting device that sets a sewing condition for each stitch pattern, the sewing condition being used for forming the stitch pattern by the stitch formation mechanism;

a non-volatile memory that rewritably stores the sewing condition; and a writing device that writes the sewing condition into the non-volatile memory in correspondence with each stitch pattern set by the sewing condition setting device.

2. The sewing machine according to claim 1, further comprising a reset device that allows the stitch formation mechanism to form the stitch pattern according to a sewing condition default value.

3. The sewing machine according to claim 2, wherein the reset device includes a sewing condition default value storage device that stores the sewing condition default value.

4. The sewing machine according to claim 1, further comprising a display including a touch key panel thereon, wherein the sewing condition setting device includes a setting key for setting the sewing condition on the touch key panel, the writing device includes a writing key on the touch key panel for instructing writing of the stitch condition into the non-volatile memory.

5. The sewing machine according to claim 4, wherein the touch key is disposed near the setting key on the touch key panel.

6. The sewing machine according to claim 5, wherein the reset device includes a reset key on the touch key panel, and the reset key is disposed near the setting key.

7. The sewing machine according to claim 2, wherein the non-volatile memory preliminarily stores the sewing condition default value for the plurality of kinds of stitch patterns in an initial state.

8. The sewing machine according to claim 1, wherein the sewing condition includes at least one of stitch width, stitch length, thread tension, thread density, and presser foot type or presser foot pressure.

9. A method for setting stitch conditions for a utility stitch sewn by a sewing machine, comprising:

turning on the sewing machine;

reading sewing conditions for each stitch of a plurality of utility stitches from a first memory;

writing sewing conditions for each stitch of the plurality of utility stitches in a second memory;

displaying a selection screen showing the plurality of utility stitches;

selecting a stitch from the plurality of utility stitches;

displaying the stitch conditions for the selected stitch;

editing the stitch conditions for the selected stitch; and storing the edited stitch conditions in the second memory.

10. The method according to claim 9, wherein the stitch conditions for editing include at least one of stitch length, stitch width, thread tension, thread density and presser foot type or pressure.

11. The method according to claim 9, further comprising sewing using the stitch conditions stored in the second memory.

12. The method according to claim 9, wherein the displaying of the selection screen, in addition to showing the plurality of utility stitches, shows the stitch conditions of a predetermined utility stitch of the plurality of utility stitches.

13. The method according to claim 9, further comprising storing default stitch conditions for each utility stitch in a third memory.

14. The method according to claim 9, further comprising overwriting the stitch conditions in the first memory with the edited stitch conditions in the second memory.

15. The method according to claim 13, further comprising resetting the stitch conditions for the selected stitch in the second memory using the stitch conditions set in the third memory.

16. A recording medium storing programs for setting stitch conditions for a utility stitch sewn by a sewing machine, comprising:

a program for reading sewing conditions for each stitch of a plurality of utility stitches from a first memory;

a program for writing sewing conditions for each stitch of the plurality of utility stitches in a second memory;

a program for displaying a selection screen showing the plurality of utility stitches;

a program for selecting a stitch from the plurality of utility stitches;

a program for displaying the stitch conditions for the selected stitch;

a program for editing the stitch conditions for the selected stitch; and a program for storing the edited stitch conditions in the second memory.

17. The recording medium according to claim 16, wherein the stitch conditions for editing include at least one of stitch length, stitch width, thread tension, thread density and presser foot type or pressure.

18. The recording medium according to claim 16, further comprising a program for sewing using the stitch conditions stored in the second memory.

19. The recording medium according to claim 16, wherein the program for displaying the selection screen, in addition to showing the plurality of utility stitches, shows the stitch conditions of a predetermined utility stitch of the plurality of utility stitches.

20. The recording medium according to claim 16, further comprising a program for reading default stitch conditions for each utility stitch stored in a storage medium.

21. The recording medium according to claim 16, further comprising a program for overwriting the stitch conditions in the first memory with the edited stitch conditions in the second memory.

22. The recording medium according to claim 16, further comprising a program for resetting the stitch conditions for the selected stitch in the second memory using the default stitch conditions set in the storage medium.

* * * * *